US007334348B2

(12) United States Patent
Morita

(10) Patent No.: US 7,334,348 B2
(45) Date of Patent: Feb. 26, 2008

(54) DRYER APPARATUS FOR CLOTHING KNITTED OR WOVEN FABRIC

(75) Inventor: Toshiaki Morita, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 52 days.

(21) Appl. No.: 10/569,281

(22) PCT Filed: Aug. 24, 2004

(86) PCT No.: PCT/JP2004/012098

§ 371 (c)(1),
(2), (4) Date: Feb. 23, 2006

(87) PCT Pub. No.: WO2005/026636

PCT Pub. Date: Mar. 24, 2005

(65) Prior Publication Data

US 2007/0011906 A1 Jan. 18, 2007

(30) Foreign Application Priority Data

Sep. 8, 2003 (JP) ..... 2003-315032

(51) Int. Cl.
*F26B 13/00* (2006.01)

(52) U.S. Cl. ..... 34/628

(58) Field of Classification Search ..... 34/597, 34/618, 621, 638, 628; 66/176; 428/292.1
See application file for complete search history.

(56) References Cited

U.S. PATENT DOCUMENTS 2,467,291 A * 4/1949 Sheidley et al. ..... 156/62.6
2,830,648 A * 4/1958 Haddox ..... 156/62.2
6,147,327 A * 11/2000 Winn ..... 219/388
2003/0148082 A1* 8/2003 Bompard et al. ..... 428/292.1

FOREIGN PATENT DOCUMENTS

| | | |
|---|---|---|
| JP | 60-60692 | 4/1985 |
| JP | 05-026574 | 2/1993 |
| JP | 09-133464 | 5/1997 |
| WO | 03/031190 A1 | 4/2003 |

* cited by examiner

*Primary Examiner*—S. Gravini
(74) *Attorney, Agent, or Firm*—Wenderoth, Lind & Ponack, L.L.P.

(57) ABSTRACT

A dryer apparatus for use with a woven and knitted fabric is constructed such that a first drying rack is disposed at an upper portion of the frame, and at least one second drying rack is disposed at a lower. Each of the drying racks is formed of a ventilated drying surface. A first drying device is disposed above the first drying rack, and a second drying device is disposed above the second rack. Each of the drying devices is formed of a drying irradiation surface for irradiating a heat ray and/or heated air, and is constructed to be movable for reciprocation along the drying surface of the drying rack by means of a driving device. The second drying device is arranged so as to be pivotable between a position in which the drying irradiation surface of the second drying device opposes an upper surface of the at least one second drying rack, and a position in which the drying irradiation surface of the second drying device opposes a lower surface of the first drying rack.

8 Claims, 5 Drawing Sheets

DRYER APPARATUS FOR CLOTHING KNITTED OR WOVEN FABRIC

TECHNICAL FIELD

The present invention relates to a dryer apparatus for use with a woven and knitted fabric, and more specifically to a dryer apparatus used for drying the woven and knitted fabric or the like, in which medical agent is applied when pretreatment is performed before inkjet printing is carried out, or for drying the woven and knitted fabric as a midterm-drying after the inkjet printing is carried out.

BACKGROUND ART

Generally, in a case when a pattern or design is drawn in a woven and knitted fabric, such as knit, sweater made of cloth, a clothing fabric, or the like, printings are performed by means of various types of printing machines, such as a flat screen, rotary screen, roller or the like.

Products made by such kinds of printings are commercialized after passing through processes such as a drying, a color appearance process, a soaping, and a finishing, after the printing.

However, in such kinds of printings, a plate has to be separately made for each of the colors to be printed by means of work such as tracing of an original picture for use in printing, reproduction or the like, thus requiring much trouble, costs, and a term.

Further, at a time for the adjusting of color paste for each of the colors and coloration change, washing work for each of the plates is also necessary and therefor it has also been a cause of lowering of the productivity.

Accordingly, as the applicant of the present invention has proposed earlier, there have been inkjet printers for mainly printing a design and a pattern of a shape on knit or clothes made of the woven and knitted fabric, or a small product as a printing object for inkjet printing, and the printed materials are naturally dried after a medical agent is applied for the pretreatment, or after the pattern of the shape is printed. However, in particular, when both of surfaces are printed, each of the surfaces is naturally dried one by one, and therefore it has required an appreciably long time (Refer to Patent Document 1).

A dryer apparatus for use in such printed materials or small lot production as printing objects does not exist heretofore.

For example, in a dryer apparatus described in Japanese Unexamined Patent Application Publication No. 9-133464, applied by Toray Industries, Inc., the dryer apparatus includes a conveyer, and warm wind is blown to the long-sheet-shaped woven and knitted fabric. Therefore, the size of the dryer apparatus is too large and the dryer apparatus is not suitable for sample printings or small lot production (Refer to Patent Document 2).

Patent Document 1: International Patent Publication No. WO03/031190

Patent Document 2: Japanese Unexamined Patent Application Publication No. 9-133464

SUMMARY OF THE INVENTION

Problems to be Solved by the Invention

The present invention is proposed in light of the above-described problems, and an object of the present invention is to provide a dryer apparatus for use in a woven and knitted fabric regardless of whether the surface to be printed is one of the side surfaces or both side surfaces, and the dryer apparatus for use in a woven and knitted fabric that is applicable for clothing made of knit, the woven and knitted fabric, or even a small product of small lot production, and that is capable of performing preferable dryings. Further, the object of the present invention is to provide a dryer apparatus that can dry the woven and knitted fabric, specifically, even a thickly formed knitted fabric with good efficiency in a short period of time.

Means for Solving the Problems

To solve the above-described problems, a dryer apparatus for use in a woven and knitted fabric with respect to the present invention is most largely characterized in that the dryer apparatus for use in woven and knitted fabric includes a frame including a first drying rack disposed at an upper step; at least one step of a second drying rack disposed at a step lower that the first rack; in which each of the drying rack is formed of a drying surface having permeability, and the frame further includes a first drying device disposed above the first drying rack; a second drying device disposed above the second rack; in which each of the drying devices is formed of a drying irradiation surface for irradiating a heat ray and/or heated air, and in which the drying devices are constructed to be movable for reciprocation along the drying surface of the drying rack by means of a driving device, and in which the drying device disposed above the second drying rack is constructed to be able to switch a direction of the drying irradiation surface from downside to upside and to be able to dry from both of an upper and a lower surfaces of the first drying rack.

Further, the dryer apparatus for use in the woven and knitted fabric is characterized in that the first and the second drying devices disposed in an up-and-down direction are controlled for sliding by means of the same driving device, or the woven and knitted fabric to be performed for drying treatment is moisturized by means of liquid for treatment performed before printing, or in printing. Furthermore, the dryer apparatus for use in the woven and knitted fabric is characterized in that the drying device includes a device for irradiating a heat ray such as an infrared ray, or the like, and the second drying device further includes a drip-proof cover at a drying irradiation surface portion thereof. Still further, dryer apparatus for use in the woven and knitted fabric is characterized in that the drying device serves as a device for irradiating the heat ray and/or hot wind from the drying irradiation surface, and includes a first drying stage to perform drying by the heat ray, and a second drying stage to perform drying by the heat ray and the hot wind, in which the reciprocating movement of the drying device at the first drying stage is performed at low speed, and the reciprocating movement of the drying device at the second drying stage is performed at speed faster than the speed of the reciprocating movement at the first drying stage.

Advantages

According to a dryer apparatus for use in a woven and knitted fabric of the present invention, a drying surface formed of a ventilated drying surface is provided at least two steps of a first drying rack and a second drying rack, and when only one face of the woven and knitted fabric is printed, only the printed surface or a treated surface is dried by means of drying surface of each of the drying racks and thereby a large number of the woven and knitted fabrics can be dried, and when both side surfaces of the woven and knitted fabric are printed, a drying irradiation surface at a lower side is upwardly turned around. Therefore, there is an advantage such that the woven and knitted fabric can be efficiently dried from above and below the first drying rack without patches.

In addition, since the woven and knitted fabric can be dried from above and below the first drying rack, drying of both surfaces can be performed not only for the woven and knitted fabric of which both surfaces are printed, but also for a thickly formed woven and knitted fabric, a sweater having a front side knitted fabric and a backside knitted fabric, or the like.

DETAILED DESCRIPTION OF PREFERRED EMBODIMENTS

Hereinbelow, a dryer apparatus for use in a woven and knitted fabric with respect to the present invention is explained on the basis of the drawings.

Figure 1:
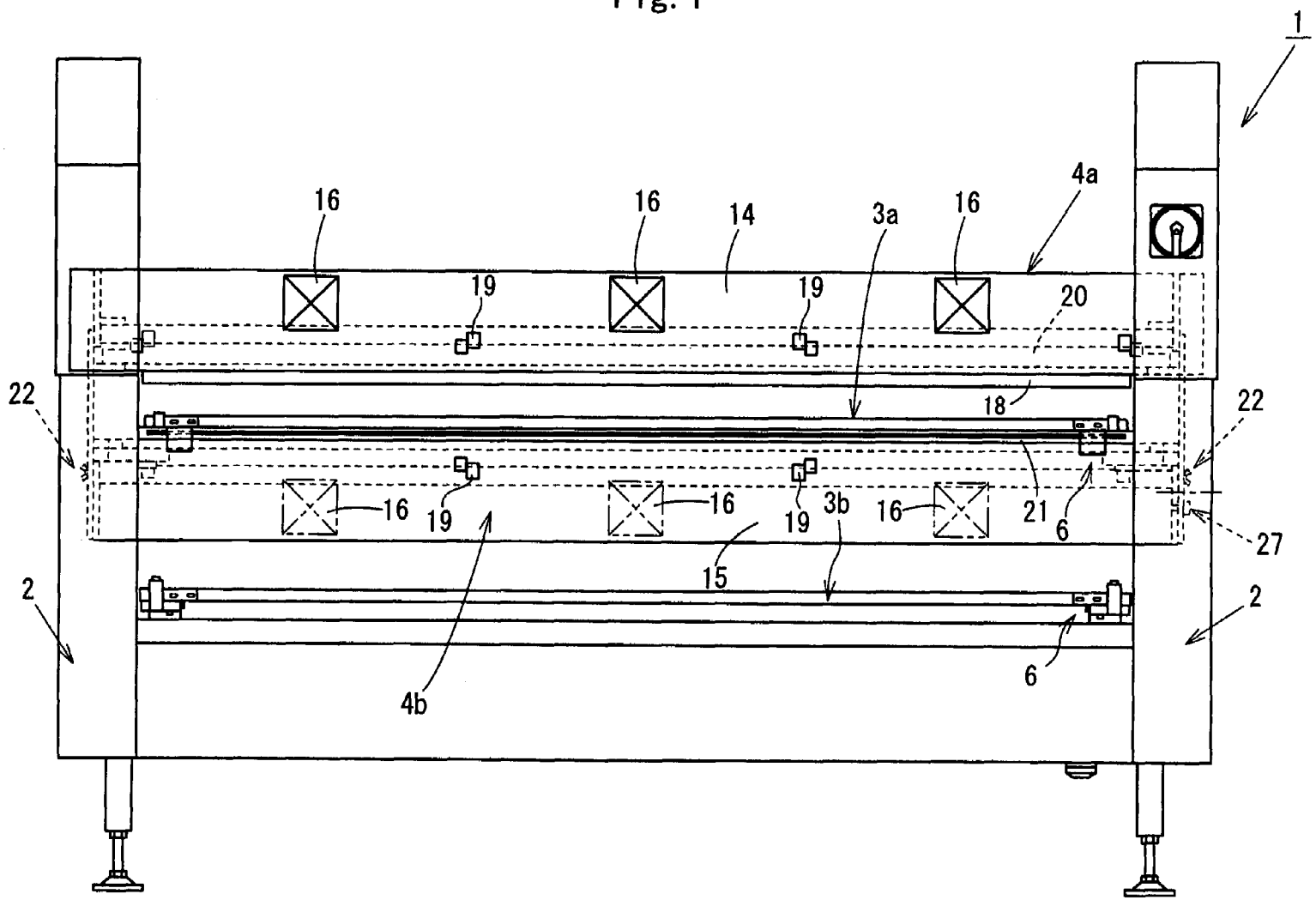
FIG. 1 is an elevation schematically showing a dryer apparatus for use in the woven and knitted fabric.

FIG. 1 is an elevation schematically showing a dryer apparatus for use in the woven and a knitted fabric, and numeral 1 in the figure entirely denotes the apparatus.

The dryer apparatus 1 for the woven and knitted fabric is configured such that a first drying rack 3*a* is disposed at an upper part of the frame 2 and a second drying rack 3*b* is disposed at a lower part of the frame 2, respectively, by means of a supporting member 6 in an up-and-down direction. A first drying device 4*a* is located above the first drying rack 3*a* disposed at the upper part of the frame 2 and a second drying device 4*b* is located above the second drying rack 3*b* disposed at the lower part of the frame 2. In addition, the first and second drying devices, 4*a* and 4*b*, are configured to be driven for reciprocating movement above the first and second drying racks 3*a* and 3*b* by means of a driving device 5, described later and shown in FIG. 5.

Figure 2:
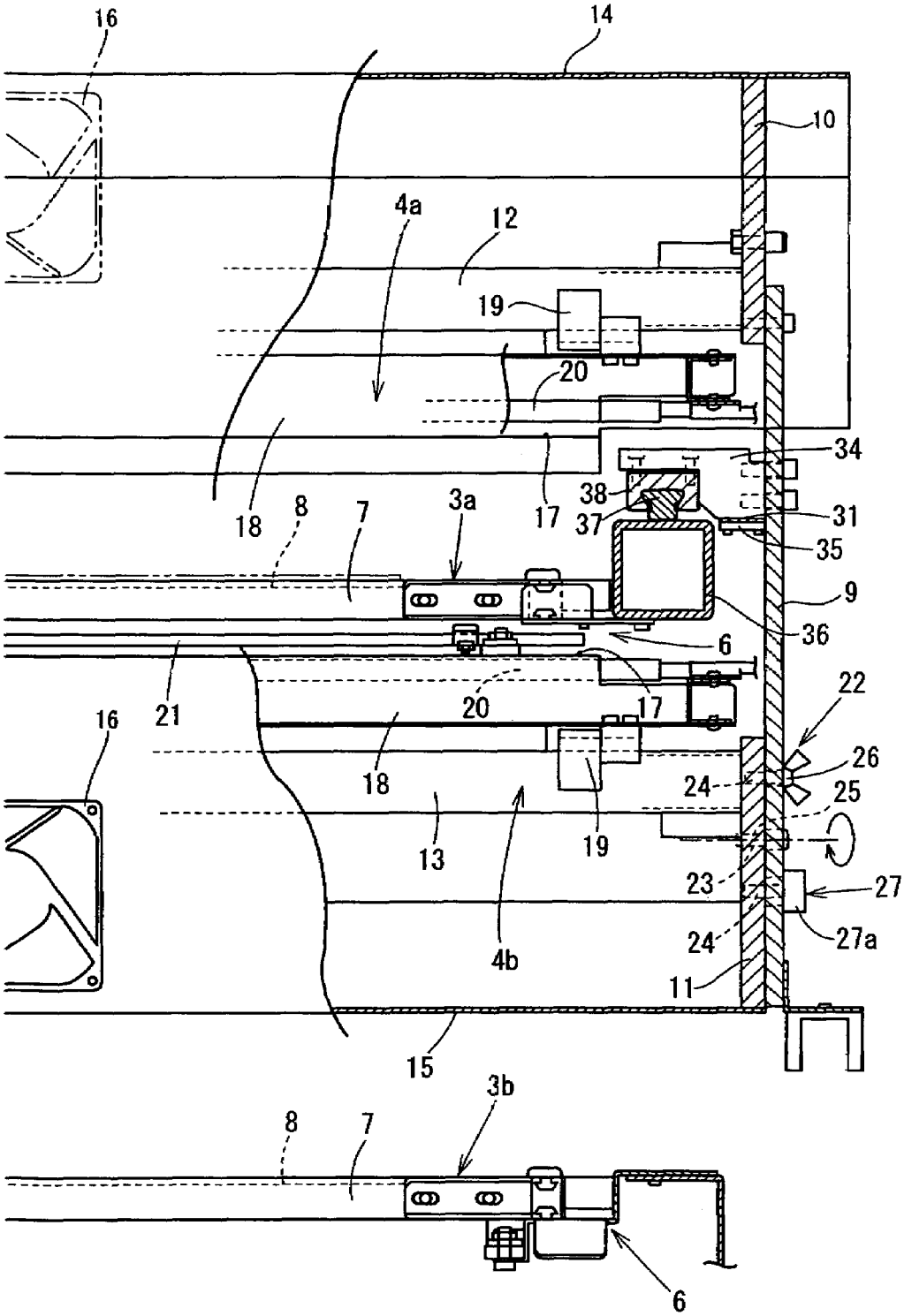
FIG. 2 is an elevation showing part of a drying device and a drying rack.

In the aforementioned first and second drying racks 3*a* and 3*b*, a drying surface 8 is formed where a net made of metal is tacked across a frame body 7 which is supported by means of a supporting member 6. Further, each of the first and second drying racks 3*a* and 3*b* is configured to be independently pulled out and taken out from the frame 2 by means of sliding at a portion of the supporting member, as shown in FIG. 2.

The aforementioned first and second drying devices 4*a* and 4*b* are configured such that a moving bracket 9 that moves from one end of the first and second drying racks, 3*a* and 3*b* to the other end thereof by means of the driving device 5 is disposed at both sides of the supporting member 6 of the first and second drying racks, 3*a* and 3*b*. At each end of the moving bracket 9, a side board 10 of the first drying device 4*a* and a side board 11 of the second drying device 4*b* are provided, respectively, and across each of the side boards 10 and 11, beams 12 and 13, having a closed section, and covers 14 and 15, having approximately C-shaped section are constructed, and a plurality of fans 16, for use in air sending are attached at a side face portion of the covers 14 and 15, at even intervals (Refer to FIG. 1).

In each of the covers 14 and 15, a reflecting plate 18 having a trapezoid-shaped section, one side of which opens to serve as a drying irradiation surface 17 is attached to the beams 12 and 13 via a bracket 19. A heater 20 is attached to an inside of the reflecting plate 18 (Refer to FIG. 2).

Figure 3:
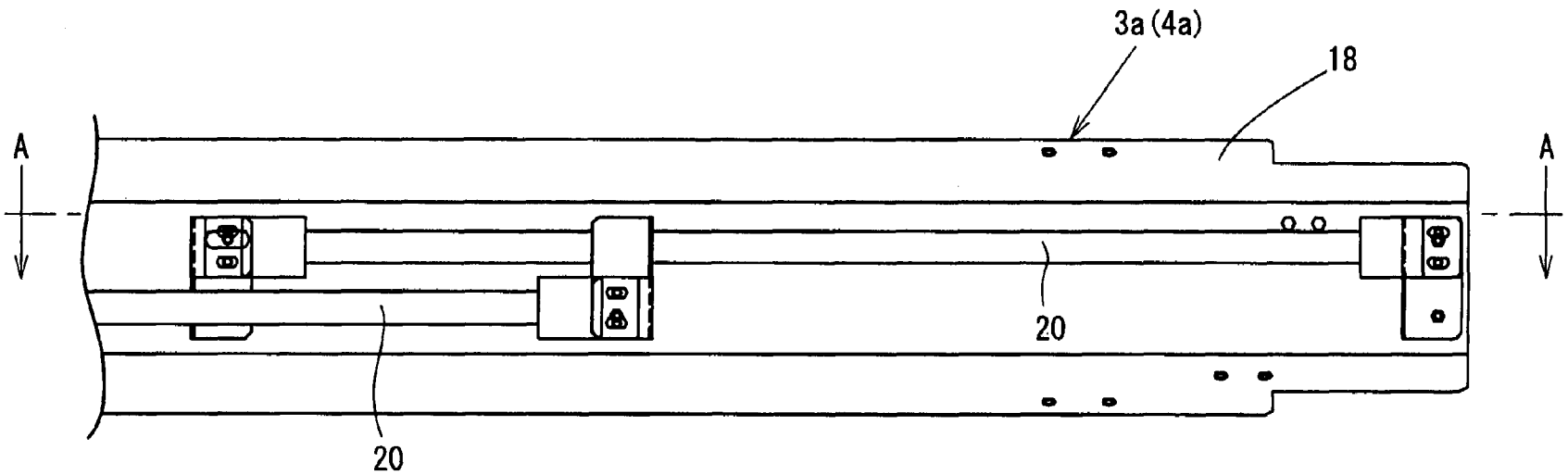
FIG. 3 is a looking-up view showing a heater attaching portion.
Figure 4:
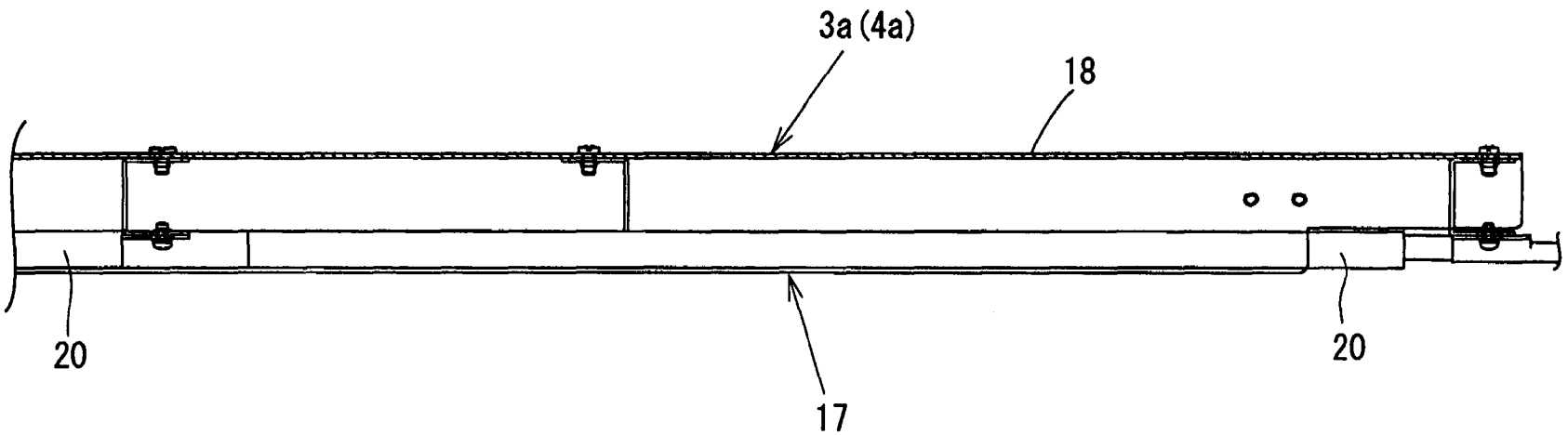
FIG. 4 is a cross-section of A-A line of the heater attaching portion.
Figure 5:
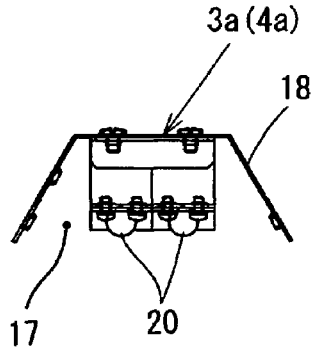
FIG. 5 is a side view showing the heater attaching portion.

Incidentally, the heaters 20 to be mounted on the first and second drying devices, 4*a* and 4*b*, are configured such that the drying device irradiates a heat ray, such as an infrared ray, or the like having a wave form of from 780 nm to 1 mm. As shown in FIGS. 3 through 5, the first and second drying devices 4*a* and 4*b* are formed by attaching a plurality of far-infrared ray heaters having a predetermined dimension in a line like manner.

Further, a drip-proof cover 21 formed of heat resistance glass is attached to an opening portion of the reflecting plate 18 of the second drying device 4*b*, and the second drying device 4*b* is configured to be rotatable between the side board 11 and the moving bracket 9 by means of a rotation mechanism 22 at 180 degrees.

The rotation mechanism 22 of the aforementioned second drying device 4*b* is configured such that a rotation pivot hole 23 is formed in the side board 11, as shown in FIG. 2. Further, screw holes, 24, for fixing are formed at two places, i.e., an upper portion and a lower portion on a concentric circle around the rotation pivot hole 23. The side board 11 is rotatably supported because a pivot shaft 25 being protruded from the moving bracket 9 is fitted into the rotation pivot hole 23. Further, the position of the drying device 4*b* of the lower side is configured to be fixed by means of fitting a butterfly bolt 26 inserted from the moving bracket 9 into one of the screw holes 24 for fixing.

Incidentally, a numeral 27 in the figure denotes an assisting member for positioning having a knob portion 27*a*. A tip end portion of the assisting member 27 is kept under tension to be protruding toward the side board 11 side by means of a spring (not shown) built in the tip end side portion (below the neck portion) from the knob portion 27*a* in the assisting member 27.

Thus, when the second drying device 4*b* is turned around and the drying irradiation surfaces 17, are thereby positioned in a manner so as to sandwich the first drying rack 3*a*, the drying irradiation surface 17 at a lower side is configured to be located in a manner so as to be closer to the drying rack than is the drying irradiation surface 17 at an upper side, namely located to an asymmetry position.

Figure 6:
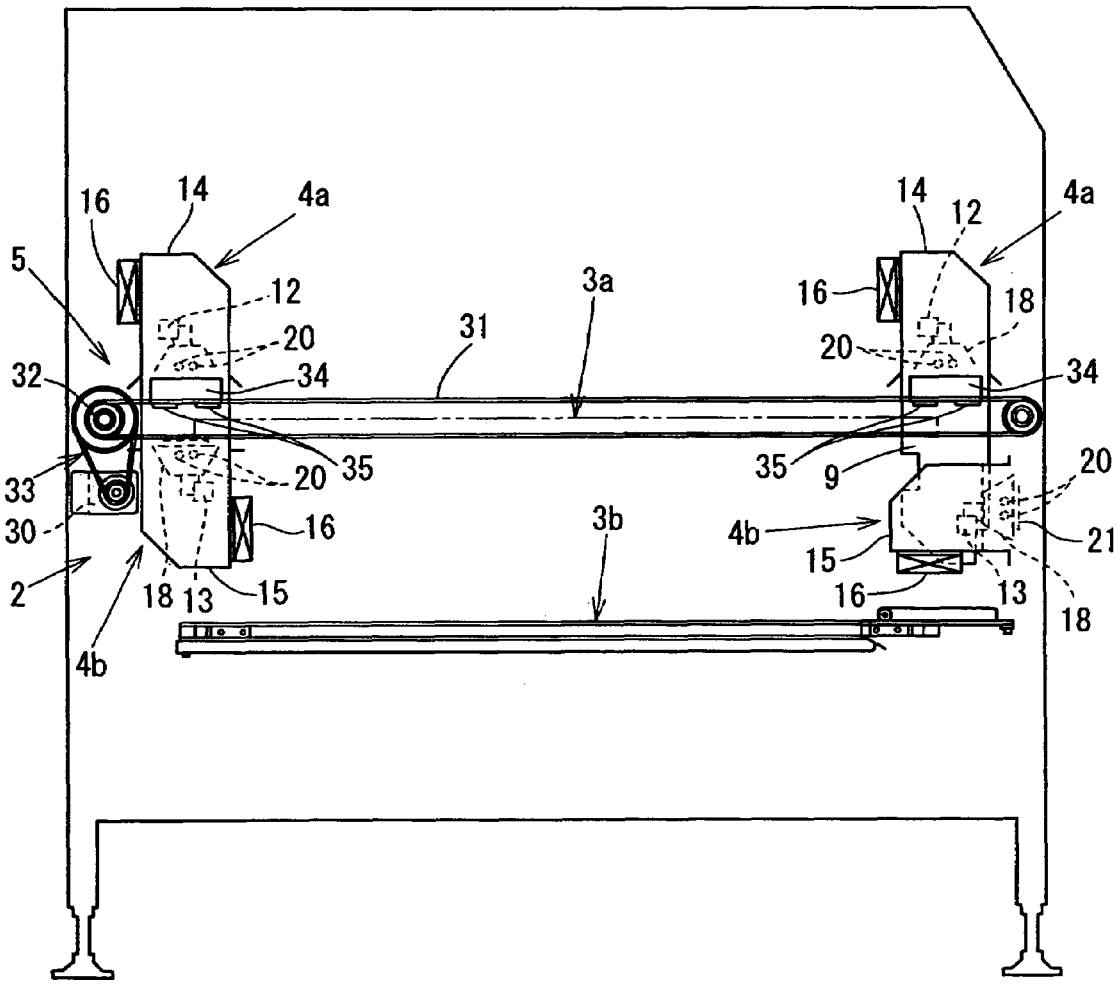
FIG. 6 is a side view schematically showing a drying device.

Further, the driving device 5 that drives for sliding the aforementioned first and second drying device 4*a*, and 4*b* for sliding, is composed of an electric motor 30 fixed to the frame 2, a drive belt 31 provided across an entire length of the first and second drying racks 3*a* and 3*b*, a transmission apparatus 33 for transmitting rotation of the electric motor 30 to a pulley 32 at an end of the drive belt 31 at decreased speed, and a clamp 35 of a carrier 34 provided at a middle portion of the moving bracket 9 is connected to the drive belt 31, as shown in a schematic view in FIG. 6.

The carrier 34 spans across supporting beams 36 at a side of the first drying rack 3*a* from the front side to the rear side of the frame 2, and is movably supported by a guide rail 37 attached to an upper surface of the supporting beam 36 via a slider 38, as shown in FIG. 2.

The electric motor 30 is controlled by means of an automatic control apparatus (not shown) on the basis of signals from various kinds of sensors (though not shown, for example, a temperature sensor, an end position sensor for the clothing fabric, or the like). Accordingly, an output power of the fan 16 for use in air sending, or that of the heater 20 of the first and second drying devices 4*a* and 4*b*, and a dimension or speed of a reciprocating movement of the first and second drying devices 4*a* and 4*b* are controlled.

Incidentally, the right side in FIG. 6 corresponds to a front side of the drying apparatus 1, and the left of FIG. 6 is an illustration showing a state, in which a second drying device 4*b* is upwardly turned around and in which the first drying rack 3*a* is dried from above and below, whereas the right of FIG. 6 is a schematic illustration showing the second drying device 4*b* in the middle of being upwardly turned around.

A case in which the thus constructed drying apparatus 1 for the woven and knitted fabric is used will be explained below.

First, in order to improve fixing capability for the ink sprayed by means of an inkjet printer (not shown), liquid for pretreatment is applied to the clothing fabric (woven and knitted fabric) portion of a sweater or the like to be inkjet printed and the clothing fabric portion is brought to a state to be moisturized.

In a case when the portion to be inkjet printed is, for example, only a front side portion of the sweater or the like, the clothing fabric is mounted on each of the first and second drying racks 3*a* and 3*b* in a state that the clothing fabric is developed such that the front side portion to which the pretreatment is applied faces upward, namely, faces each of the drying irradiation surfaces 17 of the first and second drying devices 4*a* and 4*b*.

Next, when the drying apparatus 1 is started, the clothing fabric is treated by the dimension or speed of the reciprocating movement of the first and second drying devices 4*a* and 4*b*, the output power of the heater 20 and the air volume of the fans 16 for use in the air sending, which is set by means of the automatic control apparatus on the basis of signals from various kinds of sensors, and is brought to predetermined humidity.

At this moment, although an automatic control for the dimension, the speed, or the number of the reciprocating movement of the first and second drying devices 4*a* and 4*b*, or an output control of the output power of the heater 20, the air volume of the fans 16 for use in sending air, or the like is automatically controlled by means of a program set in advance to the automatic control apparatus by the temperature sensor, a moisture percentage sensor, a thickness sensor for the clothing fabric, or the like, the program can be modified by hand and performed.

In other words, when material of the clothing fabric mounted on each of the first and second drying racks 3*a* and 3*b* is different, or the like, the output power of the aforementioned heater 20, and the air volume or the like of the fans 16 for sending air of the first and second drying devices, 4*a* and 4*b*, can be adjusted to be different from each other an and excess or deficiency of drying can be prevented.

Incidentally, since a percentage of moisture content is high at the initial stage of the drying, the drying of the clothing fabric is performed by using only the heater 20 and by causing the reciprocating movement of the first and second drying devices 4*a* and 4*b* to be slow in order to prevent medical agent from being affected by wind from the fan 16 for sending air. Along with the advancement of drying, the moving speed of the first and second drying devices 4*a* and 4*b* is gradually increased and the drying is accelerated.

By means of performing such a process, the time required for drying can be reduced.

Further, when the end position sensor for the clothing fabric detects an end portion of the clothing fabric mounted on the first and second drying racks 3*a* and 3*b* in a moving direction, the movement of the first and second drying devices 4*a* and 4*b* is reversed so as to prevent needless output of the heater 20 and the fan 16 for sending air, and efficiency of the dimension of the reciprocating movement.

Furthermore, when the end position sensor for the clothing fabric detects the end portion in a width direction perpendicular to the moving direction of the clothing fabric which is mounted on the first and second drying racks 3*a* and 3*b*, the output power of the heater 20 at a part positioned outside of the end of the clothing fabric is turned off, resulting in the reduction of power consumption.

In addition, in a case when the portion to be inkjet printed is a front side portion and a backside portion (including an entire periphery) of the sweater, or the like, for example, the clothing fabric is mounted on the first drying rack 3*a* in a developed state, and the second drying device 4*b* is turned around.

When the knob portion 27*a* of the assisting member 27 for positioning is pulled after the butterfly bolt 26 is loosened, and a tip end portion of the knob portion 27*a* is brought to a state to be pulled out from a screw hole 21 for fixing of the side board 11, the second drying device 4*b* is rotated by a small force around the pivot shaft 25. Further, the second drying device 4*b* is turned around to reach a state for the drying irradiation surface 17 to be proximally in contact with a lower face of the first drying rack 3*a*, as shown in the figure at the left in FIG. 6, and in FIGS. 1 and 2, after passing through a state, shown in the figure at the right in FIG. 6.

At a time when the second drying device 4*b* is turned around, when the knob portion 27*a* of the assisting member 27 is released, since a tip end thereof is always pressed and kept under tension toward a side board 11 side, the tip end automatically fits into the screw hole 24 for fixing when the same reaches a position to face the tip end, and the butterfly bolt 26 is brought to a state to be aligned with the screw hole 24 for fixing.

Accordingly, when only the butterfly bolt is operated for rotation in a direction to be screwed, the butterfly bolt can be screwed into the screw hole 24 for fixing and the drying device 4*b* can be firmly fixed in a state that the drying irradiating surface 17 is proximally in contact with a lower face of the first drying rack 3*a* at the upper side.

Thus, when the drying irradiation surface 17 is fixed in a state that the same is proximally in contact with the lower face of the drying rack 3*a* at the upper side, the dimension and the speed of the reciprocating drive for the first and second drying device 4*a* and 4*b*, the output power of the heater 20, the air volume of the fans 16 for sending air, or the like is automatically controlled by means of the program preset to the automatic control apparatus by the temperature sensor, a moisture percentage sensor, a thickness sensor for the clothing fabric, or the like, and the drying is performed.

Incidentally, the reason why the drying irradiation surface 17 is configured to be in closer contact with the drying rack 3*a* than the drying irradiation surface 17 at the upper side when the drying device 4*a* of the lower side is upwardly turned around is to compensate with the heat ray irradiated by the drying irradiation surface 17 of the drying device 4*b* at the lower side, or the air volume which are interrupted by the drying surface 8 made of metal and the drip-proof cover 21.

Further, the drip-proof cover 21 spread over the drying irradiation surface 17 of the drying device 4*a* at the lower side is to prevent the heater 20 from causing to short circuit by a droplet dripping down from the clothing fabric mounted on the drying rack 3*a*, or to prevent the heater 20 from adhering of lint or moisture.

Furthermore, in the above-described embodiment, a case that the pretreatment liquid applied to the clothing fabric before printing is explained as an example. However, it is natural to say that, for example, in a case of cotton or the like, the dryer apparatus for use in the woven and knitted fabric can be also used for a midterm-drying.

In addition, in the embodiment described-above, the drying rack being constructed to be two steps of the lower side and upper side is illustrated, however, the present invention can be carried out by providing three or more drying racks and by providing the drying device corresponding to the drying rack, without being limited to such a construction.

REFERENCE NUMERALS

1: dryer apparatus for use in woven and knitted fabric
2: frame
3*a*, 3*b*: drying rack
4*b*, 4*b*: drying device
8: drying surface
17: drying irradiation surface
20: heater
21: drip-proof cover

The invention claimed is:

1. A dryer apparatus for use with a woven and knitted fabric, comprising:

a frame;

a first drying rack disposed at an upper portion of the frame;

at least one second drying rack disposed at a portion of the frame lower than that of the first drying rack, each of the first drying rack and the at least one second drying rack having a ventilated drying surface;

a first drying device disposed above the first drying rack; and a second drying device disposed above the at least one second drying rack and below the first drying rack each of the first drying device and the second drying device having a drying irradiation surface for irradiating at least one of a heat ray and heated air, wherein the first drying device and the second drying device are arranged so as to be reciprocatable along the drying surfaces of the first drying rack and the at least one second drying rack, respectively, by a driving device, and wherein the second drying device is arranged so as to be pivotable between a position in which the drying irradiation surface of the second drying device opposes an upper surface of the at least one second drying rack, and a position in which the drying irradiation surface of the second drying device opposes a lower surface of the first drying rack.

2. The dryer apparatus for use with the woven and knitted fabric according to claim 1, wherein the first drying device and the second drying device are arranged so as to be reciprocatable by a same driving device.

3. The dryer apparatus for use with a woven and knitted fabric according to claim 1, wherein the woven and knitted fabric to be dried is a woven and knitted fabric which has been moisturized by a liquid before printing, or during printing.

4. The dryer apparatus for use with a woven and knitted fabric according to claim 1, wherein the second drying device further comprises a drip-proof cover at a portion of the drying irradiation surface of the second drying device.

5. The dryer apparatus for use with a woven and knitted fabric according to claim 1, wherein at least one of the first and second drying devices is operable during a first drying stage to reciprocate at a first speed, and to irradiate a heat ray from the drying irradiation surface of the at least one of the first and second drying devices, and wherein at least one of the first and second drying devices is operable during a second drying stage to reciprocate at a second speed, and to irradiate a heat ray and heated air from the drying irradiation surface of the at least one of the first and second drying devices, the second speed being greater than the first speed.

6. The dryer apparatus for use with a woven and knitted fabric according to claim 2, wherein at least one of the first and second drying devices is operable during a first drying stage to reciprocate at a first speed, and to irradiate a heat ray from the drying irradiation surface of the at least one of the first and second drying devices, and wherein at least one of the first and second drying devices is operable during a second drying stage to reciprocate at a second speed, and to irradiate a heat ray and heated air from the drying irradiation surface of the at least one of the first and second drying devices, the second speed being greater than the first speed.

7. The dryer apparatus for use with a woven and knitted fabric according to claim 4, wherein at least one of the first drying device and the second drying device comprises a device for irradiating an infrared ray.

8. The dryer apparatus for use with a woven and knitted fabric according to claim 1, wherein the first drying device is arranged such that the drying irradiation surface of the first drying device opposes an upper surface of the first drying rack, and wherein the first and second drying devices are operable to simultaneously irradiate at least one of a heat ray and heated air from the drying irradiation surfaces of the first and second drying devices to the upper and lower surfaces of the first drying rack, respectively, when the second drying device is in the position in which the drying irradiation surface of the second drying device opposes the lower surface of the first drying rack.

* * * * *